United States Patent [19]

Bell

[11] Patent Number: 4,464,992

[45] Date of Patent: Aug. 14, 1984

[54] SECTOR TYPE INITIATOR FOR ARTILLERY PROJECTILES

[75] Inventor: Frank H. Bell, Logan, Utah

[73] Assignee: Thoikol Corporation, Chicago, Ill.

[21] Appl. No.: 474,851

[22] Filed: Mar. 14, 1983

[51] Int. Cl.[3] ..... F42C 1/04

[52] U.S. Cl. ..... 102/275; 102/237; 102/241; 102/244; 102/267

[58] Field of Search ..... 102/267, 272, 275, 246, 102/244, 241, 237, 221

[56] References Cited

U.S. PATENT DOCUMENTS

| | | | |
|---|---|---|---|
| 1,042,830 | 10/1912 | Sokolowski | 102/275 |
| 1,550,978 | 8/1925 | Lukens | 102/244 |
| 2,345,618 | 4/1944 | McCormick | 102/272 X |
| 2,806,427 | 9/1957 | Hager | 102/267 |
| 3,090,311 | 5/1963 | Berger | 102/237 |
| 3,730,101 | 5/1973 | Schultz | 102/246 X |

*Primary Examiner*—David H. Brown

*Attorney, Agent, or Firm*—Gerald K. White

[57] ABSTRACT

Impact with a resistant media at adequate forward velocity and rate of rotation causes a pivoted sector weight to shear a retaining shear pin and rotate quickly, bringing a firing pin on the sector weight into violent contact with a percussion primer and thereby igniting a fuze train or high explosive booster.

3 Claims, 3 Drawing Figures

SECTOR TYPE INITIATOR FOR ARTILLERY PROJECTILES

BACKGROUND OF THE INVENTION

1. Field of the Invention

The present invention relates to fuzes or initiators for use in spinning artillery and similar projectiles.

2. Description of the Prior Art

Fuzes for use in spinning artillery and similar projectiles are well known in the prior art. Such fuzes, which generally are mounted in the nose or base of artillery projectiles, came into use with the introduction of rifled ordnance. Tight fitting cylindroogival projectiles having rotating bands sealing the rifled bore and prevented the escape past them of the burning powder gases which, prior thereto, had been utilized to activate the fuze. The problem was solved by the adoption of a mechanism that is referred to in the art as setback. This mechanism employs a striker or firing pin that is located in a hole drilled in the longitudinal axis of the fuze body. At the base of the hole is a percussion cap and below that a powder train. Upon firing of the projectile, the percussion cap is carried forward with the mass of the shell to impact on the striker. The striker, being free to float in the hole, tends to remain stationary, that is, sets back. The powder train is ignited by the resulting flash.

Such fuze mechanisms lack safety provisions, however, and careless handling or accidental dropping of the projectile was likely to cause the fuze to be activated. Many proposals for solving this problem have been made in the prior art. These proposals typically have involved the interposition of a detonation inhibiting block between the striker and the percussion cap until disengaged by centrifugal force developed by rotation of the projectile in the rifle bore. In these fuzes centrifugal means thus control the arming of the fuze. The U.S. Pat. Nos. identified in the following are a representative sample of such fuzes: 1,250,919 J. P. Madden et al; 1,311,132 C. P. Watson; 1,342,652 F. A. Sullivan et al; 1,534,012 C. P. Watson; 2,068,708 V. R. Reed; 3,375,787 D. L. Swanson; and 3,839,963 G. E. Nathan. In general, these prior art fuzes that depend upon centrifugal means for arming are complex and expensive to build.

SUMMARY OF THE INVENTION

An object of the invention is to provide a fuze or initiator for spinning artillery or similar projectiles that is energized for arming upon projectile launch but which remains unarmed until target impact.

Another object of the invention is to provide such an initiator that is insensitive to forward or aftward acceleration on the longitudinal center line or axis of the projectile.

Other objects of the invention is to provide such an initiator that does not include centrifugal means for controlling the arming thereof but instead is inertia motivated, that can be launched without a fuze setting operation, and that is markedly less complex and expensive to build than the artillery nose or base fuzes of the prior art.

In accomplishing these and other objects of the invention there is provided, according to the invention, an initiator including a pivoted rotatable flat sector shaped metallic mass with an integral firing pin and low friction bushing. The axis of the sector shaped mass rotation is the center-line of the projectile, a hard stop surface preventing rotation in a first direction, counterclockwise rotation, for example, and a retaining shear pin normally preventing rotation in a second direction opposite to the first direction, that is, clockwise rotation. The sector shaped mass lies on a plane that is orthogonal to the longitudinal axis or center-line of the projectile, and is supported fore and aft by smooth and flat metallic initiator body surfaces which are parallel to the two flat sides of the sector shaped mass. This support prevents gun or cannon launch or target impact from disabling the initiator. Upon launch, assuming projectile spin-up in the clockwise direction in the gun rifle bore, the hard stop surface prevents counterclockwise rotation of the sector mass with respect to the initiator body and the shear pin prevents chatter and clockwise rotation. Upon target impact, the rapid clockwise spin or rotation and forward motion of the projectile are sharply retarded. As rotation is rapidly slowed, an inertia load is built up on the retaining shear pin by the sector mass until the shear pin fails in shear. The sector mass-firing pin system jumps violently clockwise with respect to the initiator body to impact the percussion primer on its center-line, causing the primer to detonate, thereby igniting a fuze train or detonating a primary high explosive booster charge.

BRIEF DESCRIPTION OF THE DRAWINGS

Having summarized the invention, a detailed description follows with reference being made to the accompanying drawings which form part of the specification and of which.

DESCRIPTION OF A PREFERRED EMBODIMENT

Figure 2:
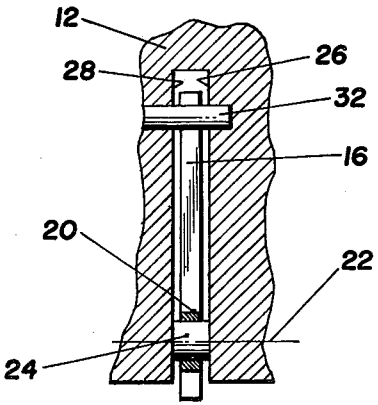
FIG. 2 is a sectional view of the initiator of FIG. 1 taken along the lines 2—2 thereof.
Figure 3:
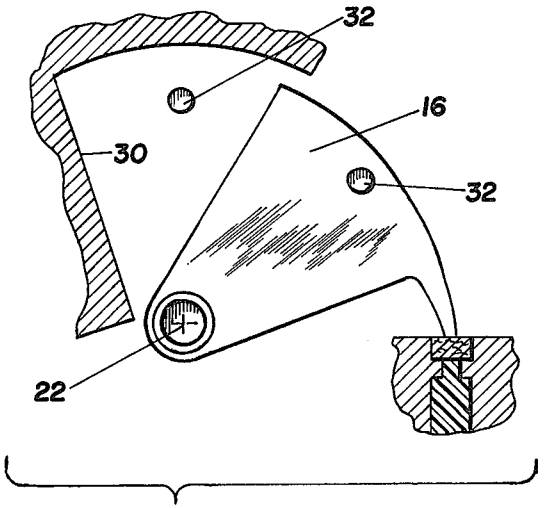
FIG. 3 is a view similar to FIG. 1 but showing the initiator in its armed and activated condition.
Figure 1:
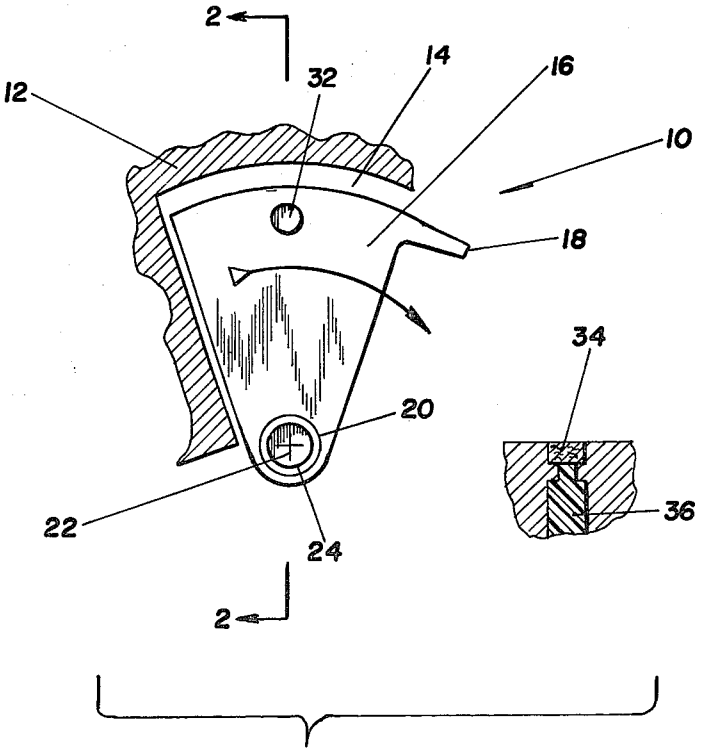
FIG. 1 comprises a schematic illustration partly in section of a sector type inertia initiator, according to the invention, for use in spinning artillery or similar projectiles.

The initiator generally designated by the reference numeral 10 is intended for application in spinning artillery or similar projectiles having a spin axis or center-line. The initiator 10 includes a metallic body or housing 12 shown in cross section and having a cavity 14 therein. Mounted within the cavity 14 is a flat sector shaped metallic mass 16 with an integral firing pin 18 and a low friction bushing 20. In plan outline as shown in FIGS. 1 and 3, the sector shaped mass 16 generally comprises part of a circle bounded by adjacent radii and the arc portion between them with the bushing 20 positioned substantially closer to the junction of the radii than the arc portion, and the firing pin 18 being formed as an integral clockwise extension of the arc portion.

The axis of rotation of the sector mass 16 is the spin axis or center-line indicated at 22 of the projectile (not shown) in which the initiator 10 is fixedly installed. Sector mass 16 and firing pin 18 lie in a plane that is orthogonal to the center-line 22, the bushing 20 being supported on an axle 24 that is suitably positioned in body 12 in alignment with said center-line 22.

Support, fore and aft, is provided for the sector mass 16 by smooth and flat metallic wall surfaces 26 and 28 of cavity 14. Surfaces 26 and 28 are parallel to the opposed flat surfaces of sector mass 16 and desirably have a smoothness of between 32 and 64 root mean square (rms) microinches. These smooth parallel supporting surfaces, being disposed in supporting relationship to the sector mass 16, prevent gun launch or target impact from disabling the initiator 10.

Counterclockwise or back rotation of the sector mass 10 about the axle 24 is prevented by a hard stop wall surface 30 of cavity 14. Normally, that is, in the inactivated condition of the initiator 10, a radial edge of the sector mass 16 is closely positioned with respect to the surface 30. Clockwise or forward rotation of the sector mass 16 is normally prevented by a retaining shear pin 32 which extends through the sector mass 16 between the side walls 26 and 28, being embedded or otherwise retained in the initiator body 12.

Positioned within, or if desired, adjacent to cavity 14 of body 12, in the plane of the sector mass 16 and thereby in the plane of the firing pin 18, is a percussion primer 34. Associated with the primer 34 is a fuze train or high explosive booster charge indicated at 36.

Upon launch of the projectile in which an initiator 10 is installed, no movement of the sector mass 16 relative to the body 12 takes place. The hard stop surface 30 prevents back rotation of the sector mass 16 with respect to body 12, due to inertia, as rapid clockwise rotation or spinning of the projectile on its longitudinal center-line 22 is developed in the gun rifle bore. The shear pin 32 prevents chatter of the sector mass 16 and also forward or clockwise rotation relative to the body 12.

Upon impact with the target, the rapid rotation and forward motion of the projectile are sharply retarded. As rotation is rapidly slowed, an inertia load is built up on the shear pin 32 until failure in shear occurs. With failure of the shear pin 32, the sector mass-firing pin system 16, 18, rotates violently clockwise causing the firing pin 18 to impact the percussion primer 34. This causes the primer 34 to detonate, thereby igniting the fuze train or high explosive booster charge 36.

Thus, there has been provided, according to the invention, an initiator for spinning artillery or similar projectiles that is energized by the spinning of the projectile upon launch but which remains unarmed until target impact. The initiator will function regardless of whether impact of the projectile is nose first, base first, side on or by tumbling, as long as the rate of rotation is high enough relative to the shear resistance presented by the shear pin 22. The initiator can be made as "safe" as desired with respect to rotation in storage and handling by simple sizing of the shear pin 32.

The initiator according to the invention is further characterized in that it is insensitive to forward or aft acceleration on the center-line of the projectile; it can be launched without a fuze setting operation; and it is markedly less complex and expensive to build than the prior art projectile nose fuze or base fuze.

I claim:

1. An initiator for a spinning projectile having a spin axis or center-line, a body having a cavity therein, a firing pin, a flat sector shaped mass in said cavity, said sector shaped mass comprising in outline part of a circle bounded by two radii and the arc portion included between them and being pivoted for rotation near the junction of said radii orthogonal to the center-line of the projectile in which said initiator is installed, said firing pin being integral with said sector shaped mass and formed as an extension of the arc portion thereof, a wall of said cavity providing a stop surface for preventing relative rotation of said sector shaped mass and said body in a first direction, a shear pin preventing relative rotation of said sector shaped mass and said body in a second direction, and a percussion primer supported by said body and positioned in the plane of rotation of said sector shaped mass and said firing pin, whereby upon launch of and rotation of the projectile in the said second direction on the center-line thereof there is no resulting relative rotation of said sector shaped mass and said body and said initiator remains unarmed, and upon impact of said projectile with a resistant media and resulting rapid decrease in the rate of rotation thereof, said sector shaped mass is caused, due to the force of inertia developed therein, to shear said shear pin and to bring said firing pin into sharp contact with said percussion primer.

2. An initiator as specified in claim 1 further including forward and aft wall surfaces of said cavity disposed in supporting relationship with said flat sector shaped mass, said forward and aft wall surfaces being parallel to the opposed surfaces of said sector shaped mass.

3. An initiator as specified in claim 2 wherein said sector shaped mass is a metallic mass and said forward and aft wall surfaces of said cavity are metallic and have a surface smoothness in the range of 32 and 64 rms microinches.

* * * * *